US010697250B2

(12) United States Patent
Galler et al.

(10) Patent No.: US 10,697,250 B2
(45) Date of Patent: Jun. 30, 2020

(54) MULTI-FUNCTIONAL CONNECTOR, DRILL HEAD, AND METHOD

(71) Applicant: SANDVIK INTELLECTUAL PROPERTY AB, Sandviken (SE)

(72) Inventors: Thomas Galler, Katsch-Mur (AT); Robert Felber, Zeltweg (AT); Christoph Haberer, Hetzendorf (AT)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 479 days.

(21) Appl. No.: 15/561,046

(22) PCT Filed: Apr. 2, 2015

(86) PCT No.: PCT/EP2015/057296
§ 371 (c)(1),
(2) Date: Sep. 23, 2017

(87) PCT Pub. No.: WO2016/155832
PCT Pub. Date: Oct. 6, 2016

(65) Prior Publication Data

US 2018/0073307 A1 Mar. 15, 2018

(51) Int. Cl.
*E21B 17/03* (2006.01)
*E21D 20/00* (2006.01)

(52) U.S. Cl.
CPC ..... *E21B 17/03* (2013.01); *E21D 20/003* (2013.01)

(58) Field of Classification Search
CPC ..... E21B 17/03; E21D 20/003
USPC ..... 173/13, 39, 90, 213
See application file for complete search history.

(56) References Cited

U.S. PATENT DOCUMENTS 1,871,528 A * 8/1932 Joline ..... F16C 1/08 464/53
3,128,674 A * 4/1964 Ganchar ..... F15B 15/16 91/167 R
3,213,642 A * 10/1965 Stern ..... F16D 7/02 464/88
3,505,831 A * 4/1970 Beach ..... F16D 1/02 464/53

(Continued)

FOREIGN PATENT DOCUMENTS

GB 382678 A 11/1932
GB 2216051 A 10/1989

(Continued)

*Primary Examiner* — Robert F Long
(74) *Attorney, Agent, or Firm* — Corinne R. Gorski

(57) ABSTRACT

A multi-functional connector is arranged for connecting a functional drill element to a drill head, such as an extendable cylinder of a drill head. The multi-functional connector includes a first connecting element having a first receptacle, a second connecting element having a second receptacle, and a retainer element having a retainer opening. The first receptacle has at least two driving surfaces for transferring a torque in a first direction, the second receptacle has at least two driving surfaces for transferring a torque in a first direction and in a second, opposite direction, and the retainer element has at least one retaining section to prevent a movement of a second functional drill element relative to the second connecting element in a retracting position of the second functional drill element.

15 Claims, 13 Drawing Sheets

(56) References Cited

Figure 1:
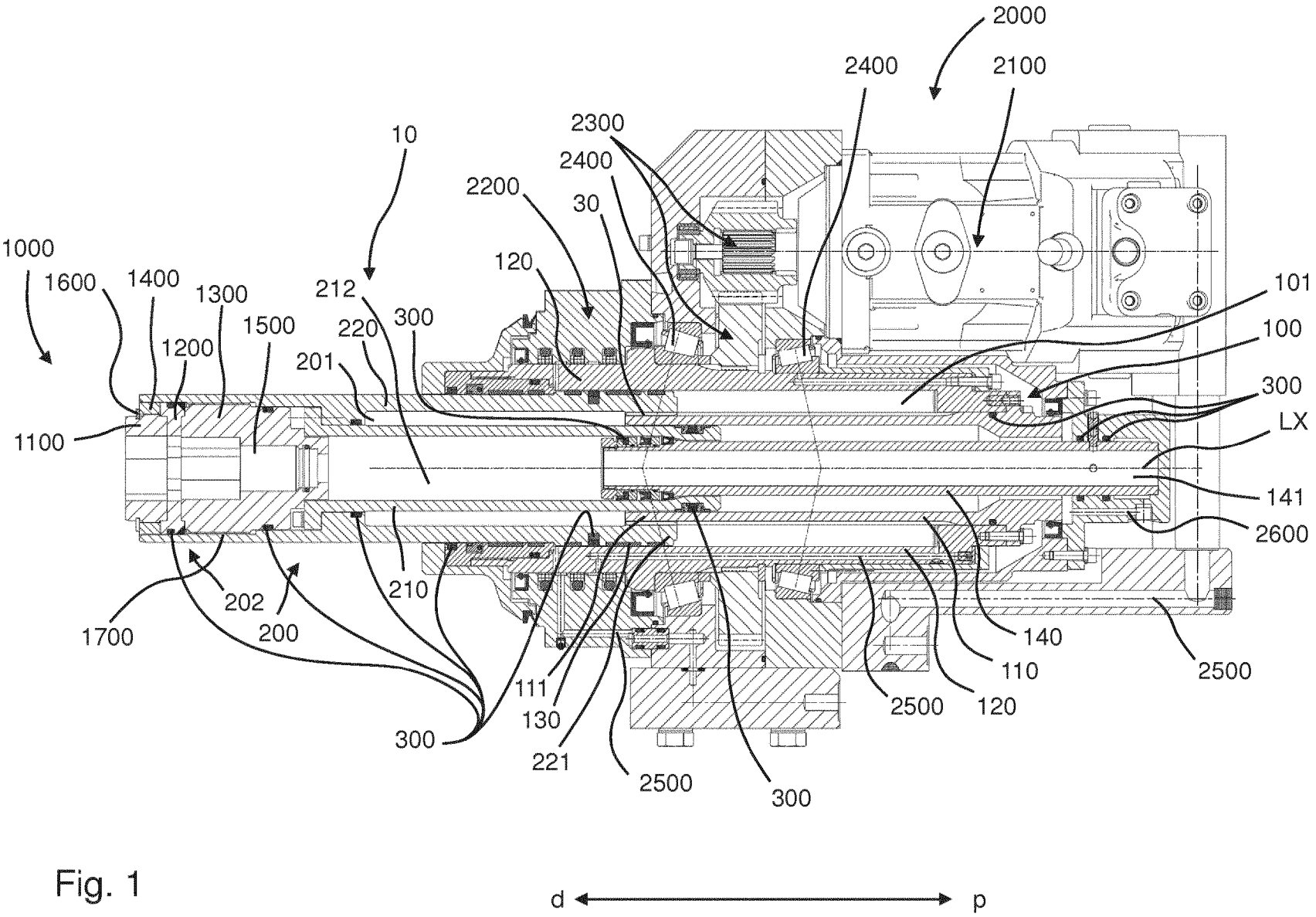

U.S. PATENT DOCUMENTS 3,603,207 A * 9/1971 Parrett ..... F15B 15/16 91/167 R
3,759,336 A * 9/1973 Marcovitz ..... B23B 31/10 173/213
3,973,468 A * 8/1976 Russell, Jr. ..... E21B 3/04 91/25
4,020,651 A * 5/1977 Callies ..... A01B 71/04 464/8
4,280,373 A * 7/1981 Denkowski ..... F16K 31/00 173/213
4,541,160 A * 9/1985 Roberts ..... F16C 1/02 29/401.1
4,553,612 A * 11/1985 Durham ..... E21B 19/086 173/152
4,575,356 A * 3/1986 Murohushi ..... F16C 1/08 464/52
4,735,119 A * 4/1988 Riley ..... B25B 17/00 74/421 R
5,016,691 A * 5/1991 Bernier ..... B23Q 35/104 144/135.4
5,125,148 A * 6/1992 Krasnov ..... E21B 17/03 175/85
5,158,458 A * 10/1992 Perry ..... A61C 8/0089 433/141
5,586,847 A 12/1996 Mattern et al.
5,613,418 A * 3/1997 Guido ..... F15B 11/036 91/167 R
5,626,474 A * 5/1997 Kukla ..... A61C 8/0089 433/141
5,806,609 A * 9/1998 Stock ..... B25D 17/005 173/111
6,035,515 A * 3/2000 Baer ..... B23P 19/00 29/505
6,079,716 A * 6/2000 Harman, Jr. ..... B23Q 3/12 279/143
6,212,763 B1 * 4/2001 Newman ..... B25B 21/002 173/180
6,463,824 B1 * 10/2002 Prell ..... B23Q 5/045 173/29
6,508,475 B1 * 1/2003 Strodtman ..... B23B 31/202 279/46.3
6,712,368 B2 * 3/2004 Bohn ..... B25F 3/00 279/143
7,004,668 B2 * 2/2006 Lombardo ..... A01D 34/416 403/293
7,228,764 B1 * 6/2007 Macor ..... B25B 13/06 81/121.1
7,308,952 B2 * 12/2007 Strazhgorodskiy ..... E21B 21/00 166/372
7,374,377 B2 * 5/2008 Bauman ..... B23B 31/008 408/239 R
7,641,000 B2 * 1/2010 Albert ..... E21B 3/025 175/61
7,717,795 B2 * 5/2010 Mellor ..... F16C 1/08 464/181
7,849,766 B2 * 12/2010 Sharifi-Mehr ..... B25B 17/02 606/104
7,870,911 B2 * 1/2011 Yoshida ..... E02D 11/00 173/184
7,950,309 B2 5/2011 Junkers et al.
8,302,708 B1 11/2012 Cox et al.
8,640,787 B2 * 2/2014 Rohrer ..... E04H 17/263 173/114
8,770,323 B2 * 7/2014 Seegmiller ..... E21B 10/327 175/273
2001/0052427 A1 * 12/2001 Eppink ..... E21B 4/006 175/40
2003/0075361 A1 * 4/2003 Terry ..... G01V 3/30 175/61
2005/0173155 A1 * 8/2005 Nevlud ..... E21B 4/00 175/57
2009/0314547 A1 * 12/2009 Stoetzer ..... E21B 7/023 175/57
2010/0132530 A1 * 6/2010 Chen ..... B21D 28/34 83/698.91
2011/0108298 A1 * 5/2011 Zhou ..... B25D 11/068 173/122
2011/0168421 A1 * 7/2011 Heichel ..... E02D 7/16 173/184
2011/0186316 A1 * 8/2011 Barhitte ..... B23Q 5/54 173/29
2011/0186322 A1 * 8/2011 Wasielewski ..... B25F 5/00 173/213
2011/0188957 A1 * 8/2011 Wasielewski ..... B23D 59/007 408/72 B
2011/0227299 A1 * 9/2011 Yu ..... B23B 31/1253 279/60
2013/0056235 A1 * 3/2013 Pozgay ..... B25B 21/00 173/29
2014/0014609 A1 * 1/2014 Stakor ..... B66C 23/84 212/276
2014/0271960 A1 * 9/2014 Sell ..... B29B 9/065 425/67
2015/0083541 A1 * 3/2015 Purohit ..... E21B 4/06 192/71
2015/0343583 A1 * 12/2015 McRoberts ..... B25F 3/00 173/213
2016/0303725 A1 * 10/2016 Goepfert ..... B25C 1/14
2017/0074355 A1 * 3/2017 Rayner ..... E21B 3/02
2017/0183911 A1 * 6/2017 Herrick ..... E21B 19/08
2018/0058151 A1 * 3/2018 Park ..... E21B 4/02
2018/0065233 A1 * 3/2018 Seith ..... B25B 21/02
2018/0073309 A1 * 3/2018 Felber ..... E21B 17/03

FOREIGN PATENT DOCUMENTS

WO 2005103450 A1 11/2005
WO 2013104012 A1 7/2013
WO 2013104017 A1 7/2013

* cited by examiner

MULTI-FUNCTIONAL CONNECTOR, DRILL HEAD, AND METHOD

RELATED APPLICATION DATA

This application is a § 371 National Stage Application of PCT International Application No. PCT/EP2015/057296 filed Apr. 2, 2015.

The invention relates to a multi-functional connector for connecting a functional drill element to a drill head, in particular to a cylinder of a drill head, in particular an extendable cylinder of a drill head. The invention further relates to a drill head comprising a multi-functional connector and a method for drilling an anchor hole and for tightening an anchor nut.

Devices and methods for installing ground anchoring systems, including drilling rock or tensioning rock bolts or other connectors, are known, for example from U.S. Pat. No. 8,770,323 B2, U.S. Pat. No. 7,950,309 B2, WO 2005/103450 A1, GB 382,678, WO 2013/104021 A1 or WO 2013/104019 A1. However, further improvements of the devices and methods are sought. For example, safety and ease of handling are important fields for improvements, as well as versatility of area of application and interaction.

It is therefore an object of the present invention to provide for an improved multi-functional connector, an improved drill head and an improved method for drilling an anchor hole and for tightening an anchor nut, which are improved over existing solutions with respect to at least one of the above-mentioned goals.

This object is solved by a multi-functional connector for connecting a functional drill element to a drill head, in particular to an extendable cylinder of a drill head, the multi-functional connector comprising a first connecting element with a first receptacle adapted for receiving a connecting section of the first functional drill element therein, a second connecting element arranged proximal to the first connecting element in a direction of a longitudinal axis of the multi-functional connector with a second receptacle adapted for receiving a connecting section of the second functional drill element therein, a retainer element arranged between the first and the second connecting element with a retainer opening for receiving the connecting section of the second functional drill element therethrough, wherein the first receptacle has at least two driving surfaces for transferring a torque in a first direction to at least two corresponding contact surfaces on the connecting section of the first functional drill element, the second receptacle has at least two driving surfaces for transferring a torque in a first direction and in a second, opposite direction to at least two corresponding contact surfaces on the connecting section of the second functional drill element in a drill and/or retracting position of the second functional drill element, and the retainer element has at least one retaining section to prevent a movement of the connecting section of the second functional drill element in a direction parallel to the longitudinal axis relative to the second connecting element in the retracting position of the second functional drill element.

The multi-functional connector is adapted to connect a functional drill element thereto, while at the same time the multi-functional connector is preferably adapted to be connected to a drill head, in particular to an extendable cylinder of a drill head. In this way, a functional drill element can be connected to the drill head via the multi-functional connector. In particular, the multi-functional connector is adapted to connect different functional drill elements to a drill head. A first functional drill element can be connected to the multi-functional connector via the first receptacle of the first connecting element, while the second functional drill element can be connected to the multi-functional connector via the second receptacle of the second connecting element. Preferably, the first and second functional drill elements are different from each other. For example, the connecting section of the first and second functional drill elements may have different cross-sectional shapes. Further, the first and second functional drill elements may have different functions, such as a drill steel and a tightening rod, for example. Preferably, only one functional drill element may be connected to the multi-functional connector at a time.

The connecting sections of the first and second functional drill elements preferably are received in the first and second receptacle preferably via corresponding cross sections, in particular via a form fit or positive fit or interlocking fit. Further preferably, the first and second receptacle are only so much bigger than the corresponding connecting section of the first and second functional drill elements to allow for the insertion and release of the respective functional drill element.

Both the first and the second receptacle have at least two driving surfaces for transferring a torque to at least two corresponding contact surfaces on the respective connecting sections of the first and second functional drill element.

The at least two driving surfaces of the first receptacle are suitable for transferring a torque in a first direction to the corresponding contact surfaces on the connecting section of the first functional drill element. This means that a first functional drill element received in the first receptacle can be driven or rotated in the first direction via the multi-functional connector. This can be particularly preferred when the first functional drill element is a tensioning rod or an anchor nut, for example.

The at least two driving surfaces of the second receptacle are adapted to transfer a torque in a first, and in a second, opposite direction to the corresponding contact surfaces on the connecting section of the second functional drill element. In particular, the second receptacle is arranged such that a second functional drill element received in the second receptacle can be rotated via the multi-functional connector in the first direction when the connecting section of the second functional drill element is in a drill position, and can be rotated in the second, opposite direction when the connecting section of the second functional drill element is in the retracting position. This can be particularly preferred when the second functional drill element is a drill steel, for example, and the multi-functional connector is connected to a drill head, wherein the drill steel needs to be rotated in the first direction to drill and rotated in the second direction during retraction of the drill steel.

The drill position and the retracting position of the second functional drill element differ preferably in their rotational orientation relative to the longitudinal axis LX. A rotation torque or driving movement is to be understood as a rotation, torque or driving movement about the longitudinal axis. Preferably, the transfer of torque in the first direction corresponds to a drill position of the second functional drill element and the transfer of torque in the second, opposite direction corresponds to a retracting position of the second functional drill element.

The second connecting element is arranged proximal to the first connecting element. Preferably, the proximal arrangement of this second connecting element relative to the first connecting element means that when the multi-functional connector is arranged at a drill head, the second connecting element is proximal or closer to the drill head than the first connecting element.

Between the two connecting elements a retainer element is arranged which has a retainer opening through which the connecting section of the second functional drill element can be put through. In order to insert the connecting section of the second functional drill element into the second receptacle, the connecting section of the second functional drill element preferably is first inserted into the first receptacle of the first connecting element, then passed through the retainer opening of the retainer element and finally inserted into and received in the second receptacle of the second connecting element.

The at least one retaining section of the retainer element has the function to retain the connecting section of the second functional drill element in its retracting position. That means that a translational movement of the second functional drill element relative to the retainer element is prevented, in particular a translational movement parallel or along the longitudinal axis in a distal direction. This has the advantage that in the retracting position, the retaining section of the retainer element ensures that the second functional drill element is removed together with the multi-functional connector and is not released from the second receptacle when the multi-functional connector is moved into the distal direction.

Preferably, the at least one retaining section does not prevent a movement of the connecting section of the second functional drill element in a direction parallel to or along the longitudinal axis relative to the second connecting element in the drill position or in a further, neutral position of the second functional drill element. Preferably, the second functional drill element is inserted into the second receptacle in the drill position or in a further, neutral position. In the drill and/or the neutral position, it is preferred that the connecting section of the second functional drill element can pass the retainer element with its at least one retaining section easily and without obstruction of the path of translational movement parallel to or along the longitudinal axis. In the retracting position of the second functional drill element, however, this relative translational movement of the connecting section of the second functional drill element relative to the second receptacle is prevented by the at least one retaining section of the retainer element In this way, the multi-functional connector has the advantage of being adapted to receive two functional drill elements (preferably one at a time) and further to transfer torque in a first direction to the two functional drill elements and further to apply a torque in a second, opposite direction to the second functional drill element in a retracting position and to further retain the second functional drill element in this retracting position. In this way, the multi-functional connector, for example, can be used with a drill head and a drill steel to drill an anchor hole, for example, and the same multi-functional connector can be used—after removal of the drill steel—to tighten an anchor nut. In particular, dollies or adapters necessary in existing solutions to attach a tightening rod, for example, to a drill head are not necessary with this multi-functional connector.

In a preferred embodiment, the second receptacle has at least two first driving surfaces for transferring a torque in a first direction to at least two corresponding first contact surfaces on the connecting section of the second functional drill element in a drill position of the second functional drill element, and the second receptacle has at least two second driving surfaces for transferring a torque in a second, opposite direction to at least two corresponding second contact surfaces on the connecting section of the second functional drill element in a retracting position of the second functional drill element.

In this embodiment, the second receptacle has at least four driving surfaces, namely at least two first driving surfaces and two second driving surfaces. The first driving surfaces are arranged to transfer a torque to two corresponding first contact surfaces on the connecting section of the second functional drill element and at least two second driving surfaces are arranged to transfer a torque in the second direction to at least two corresponding second contact surfaces. In this embodiment, preferably, the transfer of torque in the first and second direction via the second receptacle is realized by two different sets of driving surfaces contacting two different sets of corresponding contact surfaces on the connecting section of the second functional drill element.

Preferably, the first and second driving surfaces are arranged alternating along a periphery, preferably an inner periphery, of the second receptacle.

It is further preferred that between pairs of first and second driving surfaces rounded corners are arranged along the periphery of the second receptacle. This embodiment has the advantage that the insertion and removal of the connecting section of the second functional drill element from the second receptacle is facilitated. It further facilitates the transition from the drill position to the retraction position and vice versa of the connecting section of the second functional drill element.

Preferably, two adjacent first and second driving surfaces are arranged under an angle toward each other or, in other words, a first driving surface is inclined to an adjacent second driving surface.

Preferably, the at least two driving surfaces of the first and second receptacles as well as the at least two corresponding contact surfaces on the connecting section of the first and second functional drill elements extend parallel to the longitudinal axis.

It is further particularly preferred that the first driving surfaces and/or the second driving surfaces of the second receptacle are arranged to engage a connecting section of the second functional drill element with a square cross section. For example, drill steels typically have a connecting section with a square cross section. It is therefore preferred that the second receptacle is arranged to engage such a connecting section of a second functional drill element with a square cross section. However, the second receptacle can also be arranged to engage a connecting section of a second functional drill element with other cross sections, for example rectangular, hexagonal, triangular, or other polygonal or partly or fully rounded cross-sectional shapes.

In a further preferred embodiment, the retainer element has at least two retaining sections to prevent a movement of the connecting section of the second functional drill element in a direction parallel to the longitudinal axis relative to the second connecting element in the retracting position of the second functional drill element.

It is particularly preferred that the retainer element has more than one retaining section, in particular two, three, four or more retaining sections. Preferably, the retaining sections are uniformly spaced from each other. It is further preferred that the retaining sections are spaced corresponding to the second driving surfaces.

Further preferably, the first receptacle has a hexagonal cross sectional shape. A hexagonal cross-sectional shape of the first receptacle is particularly preferred since tightening rods or anchor nuts typically have a connecting section with a hexagonal cross-sectional shape. Alternatively, the first receptacle may have a square, triangular, rectangular, or other hexagonal or partly or fully rounded cross-sectional shape.

It is further preferred that an inner envelop of the cross section of the first receptacle envelops the cross section of the second receptacle and/or the retainer opening.

This embodiment is advantageous to facilitate the insertion and removal of the connecting section of the second functional drill element through the first receptacle the retainer opening into the second receptacle. In this embodiment, the open cross section of the first receptacle fully encompasses the open cross section of the retainer opening and/or the second receptacle.

In a further preferred embodiment, the retainer element has at least two guiding surfaces. Preferably, the at least two guiding surfaces are arranged such that corresponding contact surfaces of the connecting element of the second functional drill element are guided by the at least two guiding surfaces while the connecting section of the second functional drill element is passing through the retainer element. It is further preferred that the at least two guiding surfaces extend parallel to the longitudinal axis.

Further preferably, between the at least two guiding surfaces a rounded corner is arranged. This embodiment facilitates the insertion and/or removal of the connecting section of the second functional drill element through the retainer opening.

Further preferably, the at least two guiding surfaces are arranged to engage a connecting section of the second functional drill element with a square cross section in an orientation according to the drill position. This embodiment is particularly preferred when a second functional drill element in the form of a drill steel with a square cross section in its connection section is used. The guiding surfaces are particularly advantageous when they are arranged to guide contact surfaces on the connecting section of the second functional drill element while it is passed through the retainer element in the drill position.

In a further preferred embodiment, the multi-functional connector comprises an engagement element arranged at an outer periphery of the first connecting element and adapted to engage a cylinder of a drill head in a torsion proof way. The provision of an engagement element and its function to connect the multi-functional connector in a torsion-proof way to a cylinder of a drill head has the advantage that the rotation of the cylinder of the drill head can be transferred to the multi-functional connector and in this way, via the multi-functional connector, also to the first or the second functional drill element connected thereto.

The engagement element preferably connects the outer periphery of the first connecting element to the cylinder of a drill head via corresponding cross sections, form fit, positive fit or interlocking fit.

In a further preferred embodiment, the multi-functional connector comprises a fluid provision section with a fluid channel for providing fluid from a proximal end of the connector to the first connecting element and/or the second connecting element and/or the retainer element. Preferably, the fluid provision section is adapted to be connected to a fluid channel of a cylinder of a drill head, in particular an extendable cylinder of a drill head, preferably via a seal for a sealed connection. Further preferably, the fluid provision section provides a stop phase of the second receptacle at its proximal end such that a connection section of a second functional drill element received in the second receptacle is stopped in a proximal direction by the fluid provision section.

According to a further aspect, the objective is solved by a drill head, comprising an extendable cylinder with a shaft and a piston, the piston being moveable with respect to the shaft along a longitudinal axis; a drive for rotationally driving the shaft of the extendable cylinder; an extending union adapted to extend and/or retract the extendable cylinder along the longitudinal axis; a multi-functional connector as previously described at a distal end of the piston for connecting a functional drill element thereto.

As to the advantages, preferred embodiments and details of the drill head and its preferred embodiments, reference is made to the corresponding aspects and embodiments described above, in particular with respect to the multi-functional connector.

According to a further aspect, the objective is solved by a method for drilling an anchor hole and for tightening an anchor nut, comprising providing a drill head with a multi-functional connector as previously described, providing a drill steel as a first functional drill element, inserting the drill steel trough the first receptacle and the retainer opening into the second receptacle in the drill position, rotating a cylinder of the drill head with the multi-functional connector in a first direction, rotating the cylinder of the drill head with the multi-functional connector in a second, opposite direction to bring the drill steel into the retracting position, retracting the cylinder with the connector and the drill steel, rotating the cylinder of the drill head with the multi-functional connector in the first direction to bring the drill steel into the drill position, removing the drill steel from the multi-functional connector, engaging the anchor nut of an anchor with the first receptacle, rotating a cylinder of the drill head with the multi-functional connector in a first direction As to the advantages, preferred embodiments and details of the method for drilling an anchor hole and for tightening an anchor nut and its preferred embodiments, reference is made to the corresponding aspects and embodiments described above, in particular with respect to the multi-functional connector and the drill head.

The multi-functional connector preferably is applied in a combination with an extendable cylinder and its preferred embodiments described below.

A preferred extendable cylinder, in particular for a drill head, comprises a shaft with a shaft ring volume between an inner part and an outer part of the shaft; a piston with a piston ring volume between an inner part and an outer part of the piston; the piston being moveable with respect to the shaft along a longitudinal axis; a proximal end of the outer part of the piston being arranged between the inner and outer part of the shaft; and a distal end of the inner part of the shaft being arranged between the inner and outer part of the piston; and wherein the extendable cylinder is extendable and/or retractable along the longitudinal axis.

The extendable cylinder can be used for a drill head or together with a drill head, for example. The extendable cylinder comprises a shaft and a piston, with the extension of the cylinder being realized by a translational movement of the piston relative to the shaft along a longitudinal axis. A retraction of the extendable cylinder is realized by a translational movement of the piston relative to the shaft in an opposite direction. The extendable cylinder has a proximal end and a distal end. In particular, when the extendable cylinder is used in a drill head, the proximal end of the extendable cylinder would be the end connected to the drill head and the distal end would be the end connected to a functional drill element, like a drill steel, for example.

The translational movement of the piston with respect to the shaft preferably is a guided movement or a sliding movement, which preferably is controlled by an extension union for controlling the movement, for example the speed, and/or extent, and/or direction of the movement. Preferably, the extendable cylinder is extendable by at least 100 mm, in particular by at least 110, 120, 130, 140, 150, 160, 170, 180, 190, or 200 mm.

The piston and/or the shaft preferably have a substantially cylindrical shape in at least a region or portion. The inner and outer part of the shaft and/or the inner and outer part of the piston preferably are arranged coaxially with respect to the longitudinal axis. Further preferably, the inner part of the shaft circumscribes an inner or interior shaft volume and the inner part of the piston circumscribes an inner or interior piston volume.

The shaft and the piston of the extendable cylinder are arranged such that a proximal end of the outer part of the piston is positioned between the inner and outer part of the shaft and a distal end of the inner part of the shaft is arranged between the inner and outer part of the piston.

Preferably, a distal end of the piston ring volume is closed, for example by a connection between the inner and outer part of the piston. Further preferably, a proximal end of the shaft ring volume is closed, for example by a connection between the inner and outer part of the shaft. The shaft ring volume and the piston ring volume may be in fluid communication with each other.

This construction of an extendable cylinder in which inner and outer parts of the shaft and inner and outer parts of the piston intertwine provides for a very versatile extendable cylinder with characteristics allowing the application of the extendable cylinder in a wide range of applications, thereby increasing the functionality of the extendable cylinder itself and, for example, a drill head with such an extendable cylinder.

According to a preferred embodiment, the piston and the shaft are connected by a torsionally rigid coupling. A torsionally rigid coupling is to be understood as a connection, which does not allow for a relative rotational movement between the piston and the shaft. This means that when the shaft is rotated, the piston is rotated together with the shaft and vice versa. This embodiment has the advantage that the extendable cylinder is particularly suitable for use or application in a drill head, where the rotation is applied to the extendable cylinder and shall be transferred from the shaft to the piston, for example.

It is further preferred that the torsionally rigid coupling is realized by a connection of the outer part of the piston and the inner part of the shaft. This position of the torsionally rigid coupling is particularly preferred since it creates a reliable coupling and has a minimized impact on the functionality and suitability of the extendable cylinder.

It is further preferred that the torsionally rigid coupling is a spline coupling and/or a latch coupling. Further torsionally rigid couplings may be applied.

Preferably, the splines of a spline coupling run parallel to the longitudinal axis to allow for a sliding movement of the piston relative to the shaft. Further preferably, the spline coupling has a longitudinal extension, which allows for a reliable torsionally rigid coupling independent from the relative position of the piston to the shaft, i.e. along the whole extension distance of the extendable cylinder.

In a further preferred embodiment, the extendable cylinder is extendable and/or retractable by provision and/or discharge of hydraulic fluid to and/or from the shaft ring volume and/or the piston ring volume. In this embodiment, the extendable cylinder can be referred to as a hydraulic cylinder. The construction of the extendable cylinder is particularly suitable for realizing the extension and/or retraction by hydraulic fluid, since the shaft ring volume and/or the piston ring volume can be used for the hydraulic fluid. As a hydraulic fluid, in particular hydraulic oil can be used.

It is further preferred that the proximal end of the outer part of the piston is sealed against the outer part of the shaft; and the proximal end of the inner part of the piston is sealed against the inner part of the shaft.

Preferably, high-pressure seals for sealing against the leakage of hydraulic fluid are provided to realize the sealing. Further preferably, the seals are provided as sliding seals, which reliably seal in any relative position of the piston with respect to the shaft. With these seals, the shaft ring volume and the piston ring volume can be efficiently sealed against an inner or outer periphery or environment.

Further preferably, the shaft ring volume and the piston ring volume are in fluid communication with each other, preferably via the coupling between the outer part of the piston and the inner part of the shaft. This embodiment is particularly preferred in combination with the realization of the extendable cylinder as a hydraulic extendable cylinder.

It is further preferred that an intermediary ring volume is provided between the outer part of the piston and the outer part of the shaft; wherein the extendable cylinder is retractable by provision of hydraulic fluid to the intermediary ring volume.

Preferably, the extension of the extendable cylinder is initiated by the provision of hydraulic fluid to the shaft ring volume and/or the piston ring volume, while the retraction of the extendable cylinder is realized by the provision of fluid to a further ring volume, namely the intermediary ring volume. Preferably, the intermediary ring volume is separate from the shaft ring volume and the piston ring volume, i.e. the intermediary ring volume preferably is not in fluid communication with the shaft ring volume and the piston ring volume. When hydraulic fluid is provided to one ring volume to initiate a movement of the piston, hydraulic fluid preferably is discharged from another ring volume to allow for this movement.

Preferably, the intermediary ring volume is at least partly formed by a section of the outer part of the piston with a reduced outer diameter. Further preferably, the intermediary ring volume surrounds at least a section of the outer periphery of the outer part of the piston.

Preferably, the intermediary ring volume is closed at its distal end and/or its proximal end and further preferably is provided with seals, in particular high-pressure sliding seals for hydraulic fluid.

A further preferred embodiment of the extendable cylinder is characterized by at least one force transmission element between the outer part of the piston and the outer part or the shaft for transmitting lateral forces in at least one direction different from a direction parallel to the longitudinal axis.

A force transmission element is preferred to provide additional stability particularly in a fully or partly extended position of the extendable cylinder. In particular, the force transmission element is adapted to transmit lateral forces substantially orthogonal to the longitudinal axis. Lateral forces are to be understood as forces in at least one direction different from a direction parallel to the longitudinal axis. In particular, lateral forces are forces substantially orthogonal to the longitudinal axis. The force transmission element preferably is connected to the outer radial periphery of the outer part of the piston.

In a preferred embodiment, the at least one force transmission element is a ring-shaped element with an axial extension which exceeds its radial extension by at least a factor of two, and which is connected to the outer part of the piston by form fit. A form fit can be understood to be a positive fit or interlocking fit or a connection via corresponding cross sections.

This embodiment of the force transmission element has the advantage that it is a particularly cost efficient and reliable embodiment, which is also easy to assemble and manufacture.

Preferably, two ring-shaped force transmission elements are provided. The axial extension of the force transmission element preferably is 3, 4 or 5 times larger than its radial extension. Preferably, the force transmission element is made of hard plastic.

In a preferred embodiment, the outer radial periphery of the at least one force transmission element is arranged flush with the remaining outer radial periphery of the outer part of the piston surrounding the at least one force transmission element.

A further preferred embodiment of the extendable cylinder is characterized by a supply channel forming a central cavity for supplying a fluid to the piston. The fluid can be a liquid, like water, for example. This allows for wet, moist or dry drilling operation. It is preferred that all elements of a drill head, in particular all elements of the extendable cylinder, and/or a multi-functional connector that may come into contact with water or other aggressive fluids have adequate protective coatings, in particular rust persistent coatings.

The provision of a supply channel for supplying fluid to the piston further increases the versatility of the extendable cylinder, for example for the application of wet or moist drilling, when a liquid or mist is supplied through the supply channel. Preferably, the supply channel is arranged within the inner part of the piston and further preferably arranged coaxially with the piston and the shaft. A distal end of the supply channel preferably is sealed against the inner part of the piston. A distal end of the supply channel may project in a distal direction from a distal end of the shaft.

According to a further aspect, a drill head is provided, comprising an extendable cylinder as described above; a drive for rotationally driving the shaft of the extendable cylinder; an extending union adapted to extend and/or retract the extendable cylinder along the longitudinal axis; a connector, preferably a multi-functional connector, at a distal end of the piston for connecting a functional drill element thereto.

Preferably, the extending union is a rotating union in fluid communication with the shaft ring volume and/or the piston ring volume and/or the intermediary ring volume, the rotating union being adapted to provide and/or discharge hydraulic fluid to and/or from the shaft ring volume and/or the piston ring volume and/or the intermediary ring volume. Further it is preferred that the drill head comprises at least one speed sensor, preferably, arranged at a spur gear reduction stage.

Further preferably, the drill head comprises a temperature sensor and/or pressure sensor and/or a thread breaker.

As to the advantages, preferred embodiments and details of the drill head and its preferred embodiments, reference is made to the corresponding aspects and embodiments described above, in particular with respect to the cylinder.

According to a further aspect, a method of operating a drill head as previously described is provided, comprising connecting a functional drill element to the connector at the distal end of the piston; rotating the extendable cylinder by rotationally driving the shaft; extending and/or retracting the extendable cylinder along the longitudinal axis.

According to a preferred embodiment, the method of operating a drill head further comprises removing the functional drill element from the connector; connecting another functional drill element to the connector.

As to the advantages, preferred embodiments and details of the method of operating a drill head and its preferred embodiments, reference is made to the corresponding aspects and embodiments described above, in particular with respect to the cylinder and the drill head.

Figure 2:
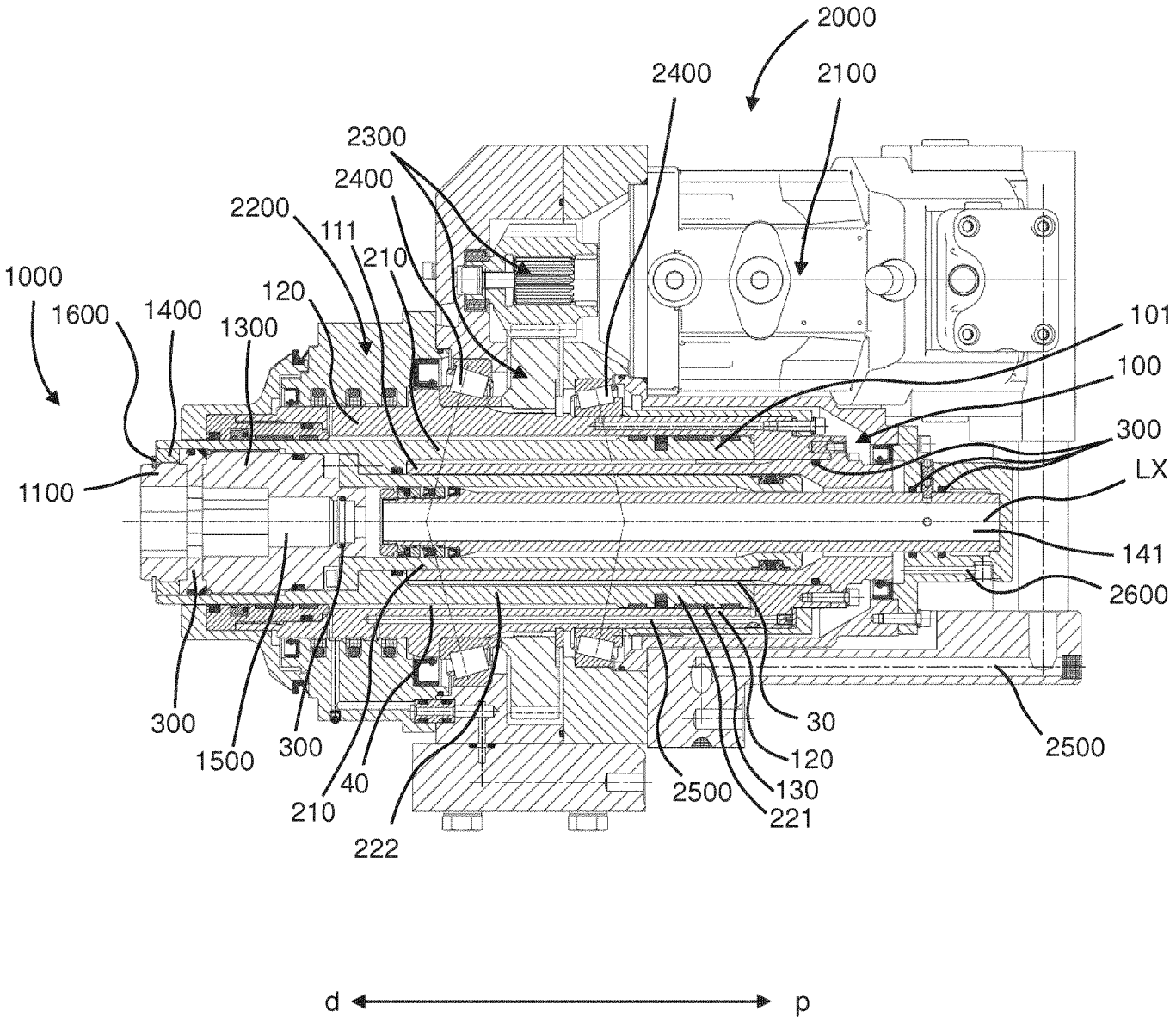
Figure 3:
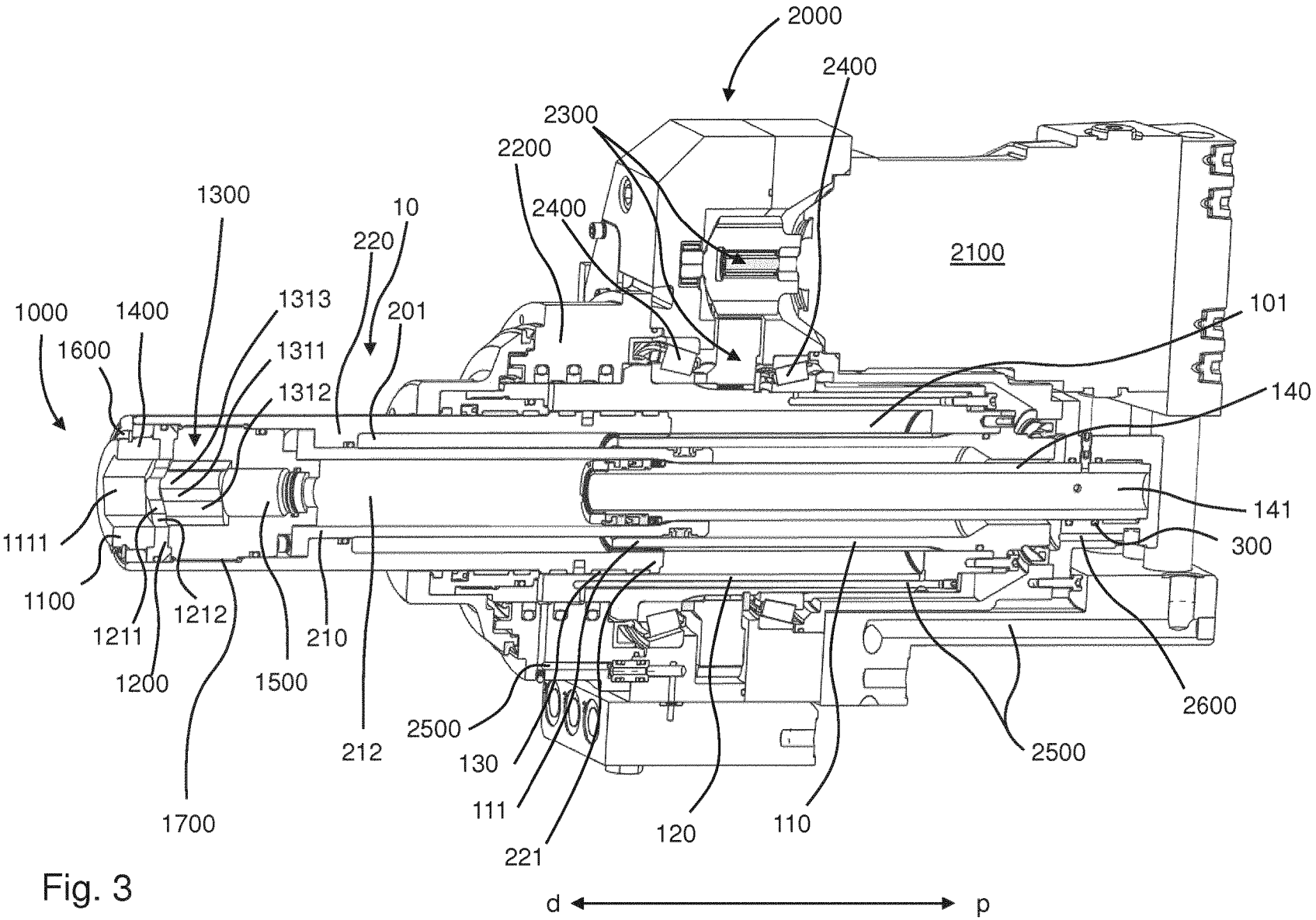
Figure 4:
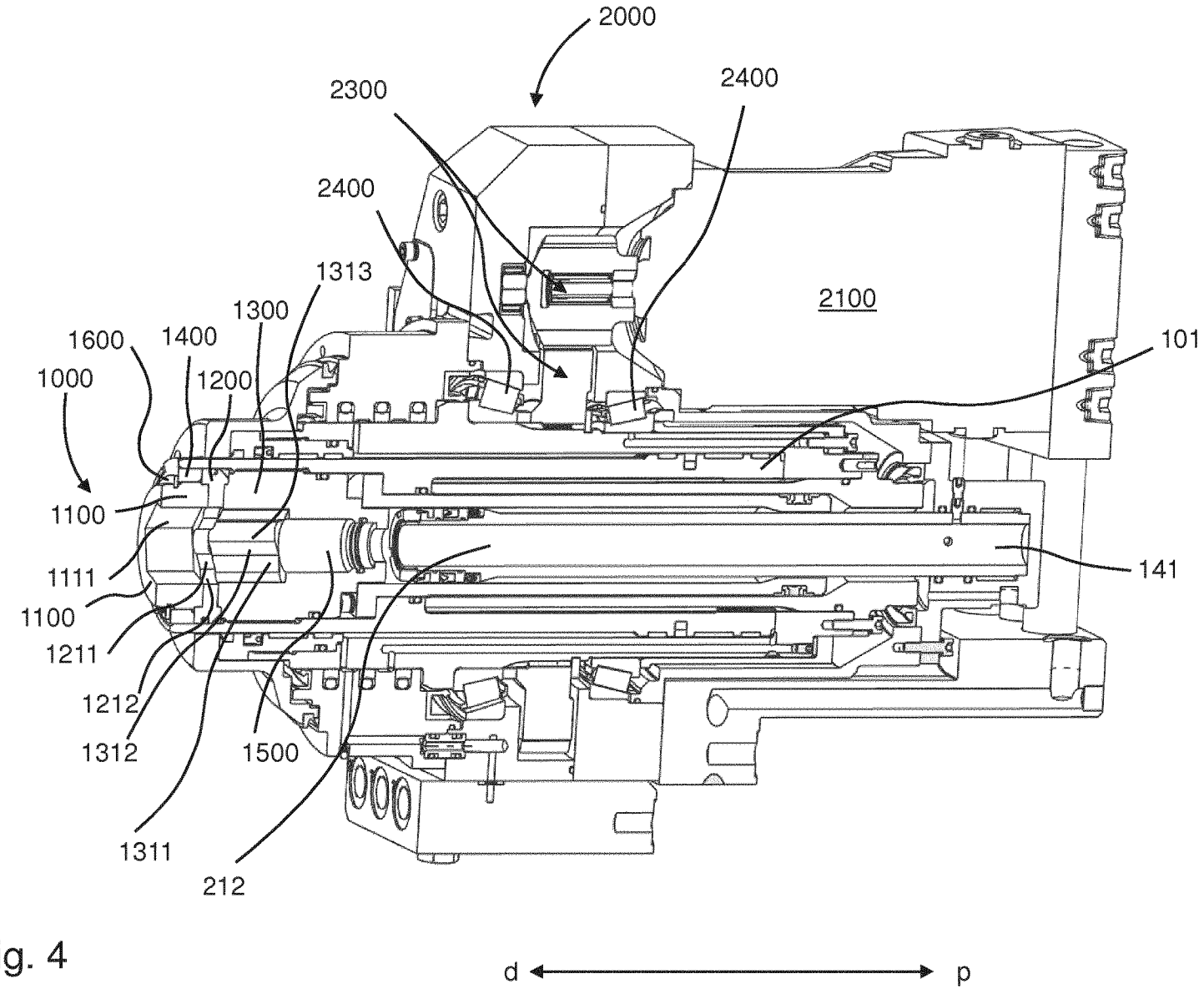
Figure 5:
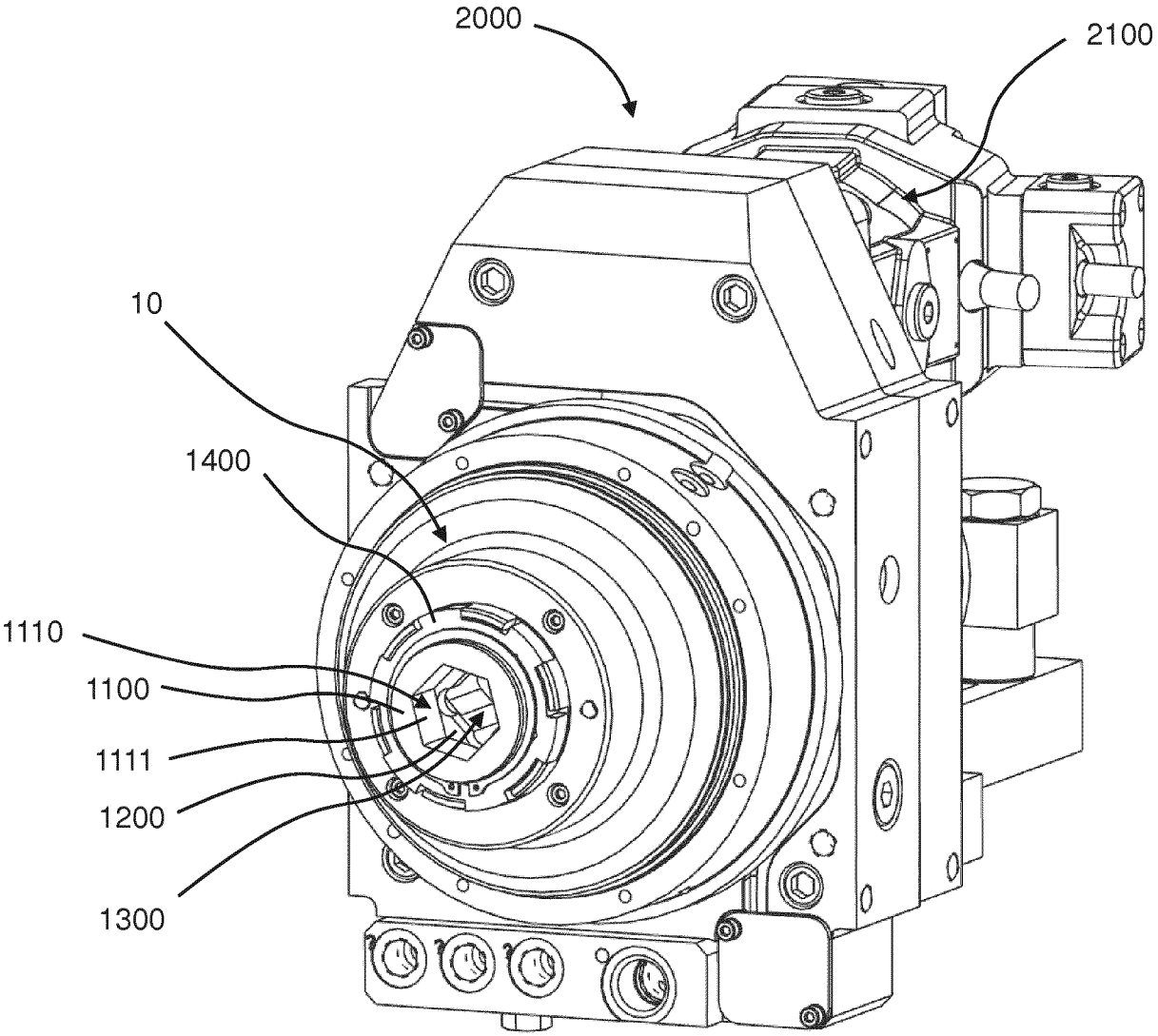
Figure 6:
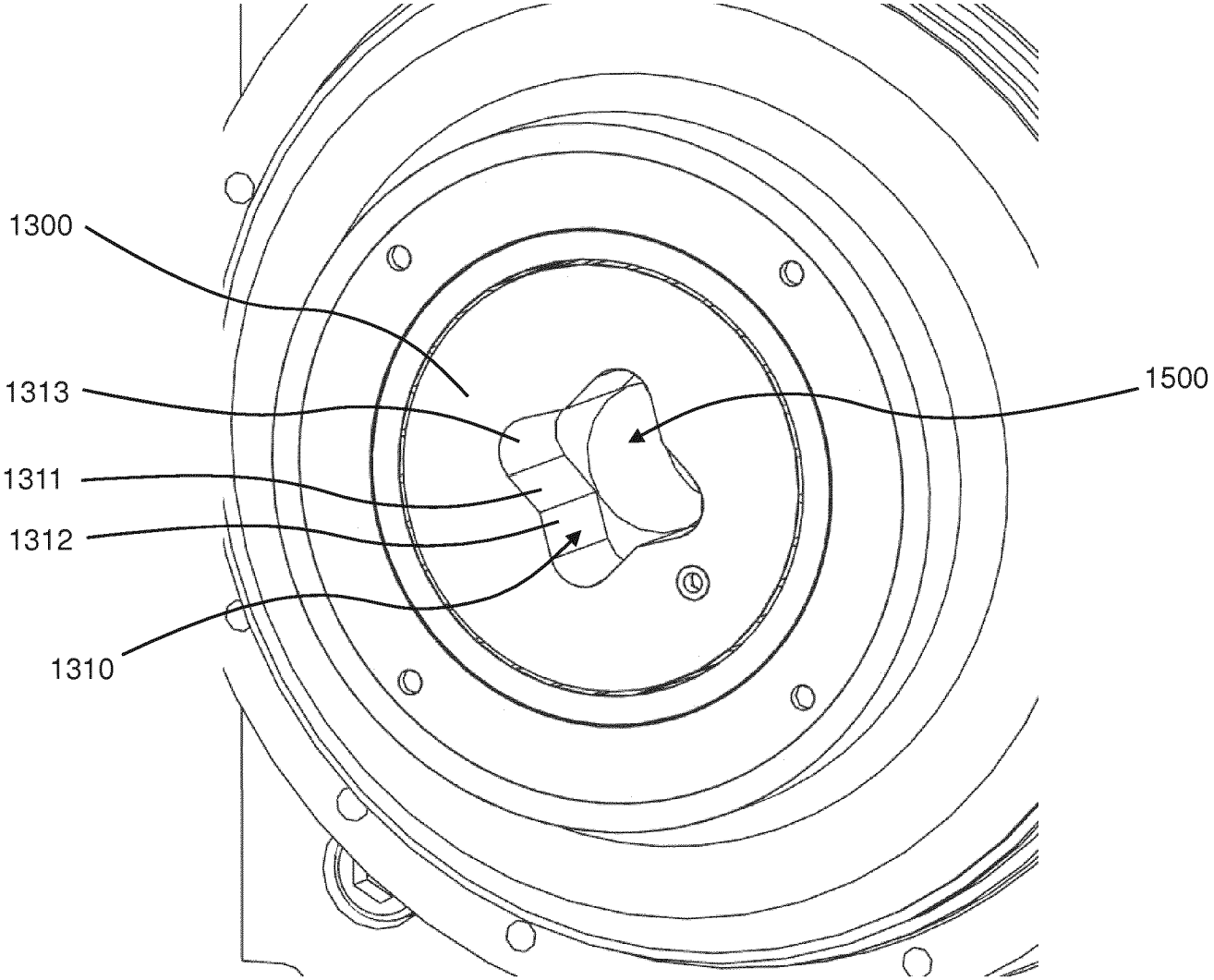
Figure 7:
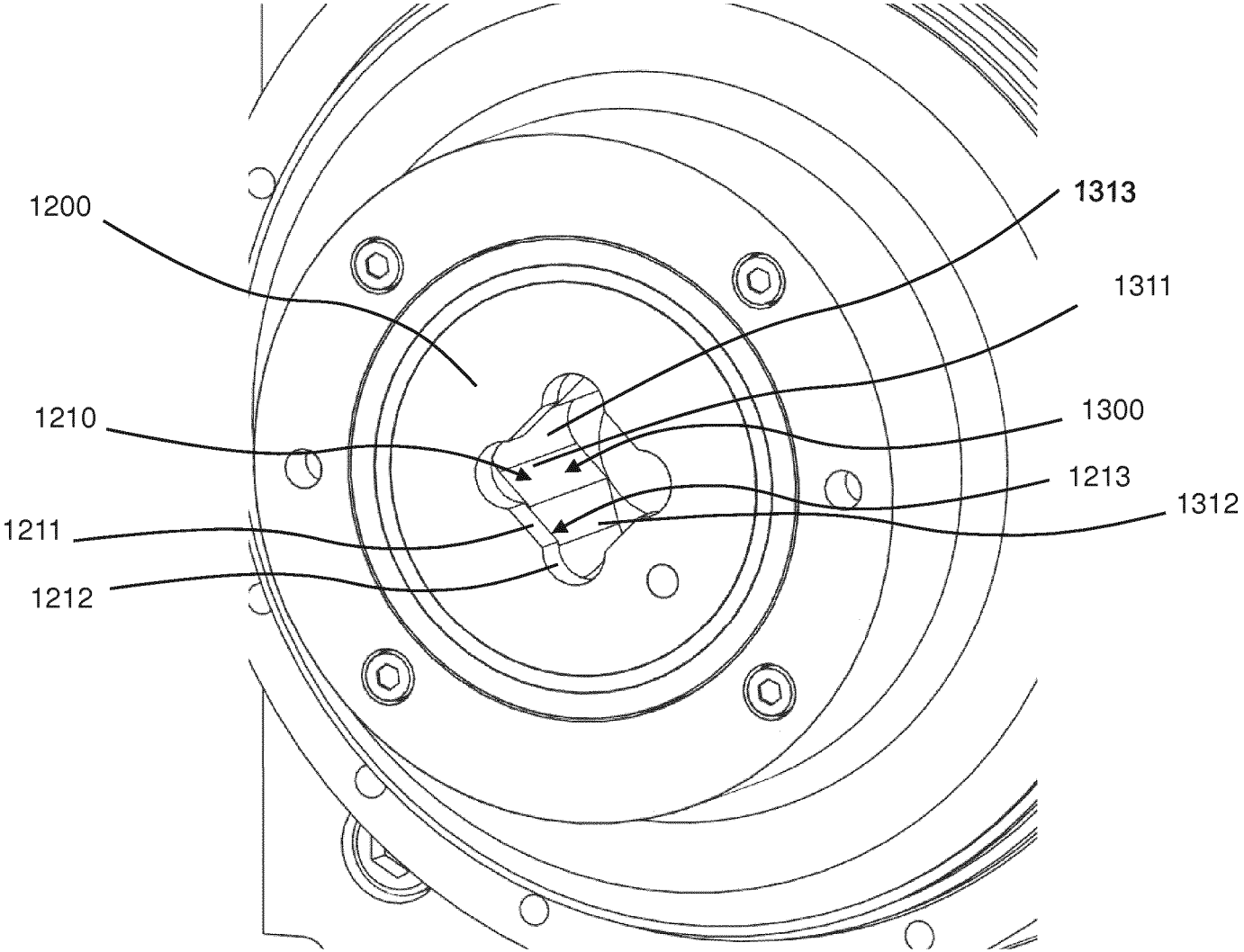
Figure 8:
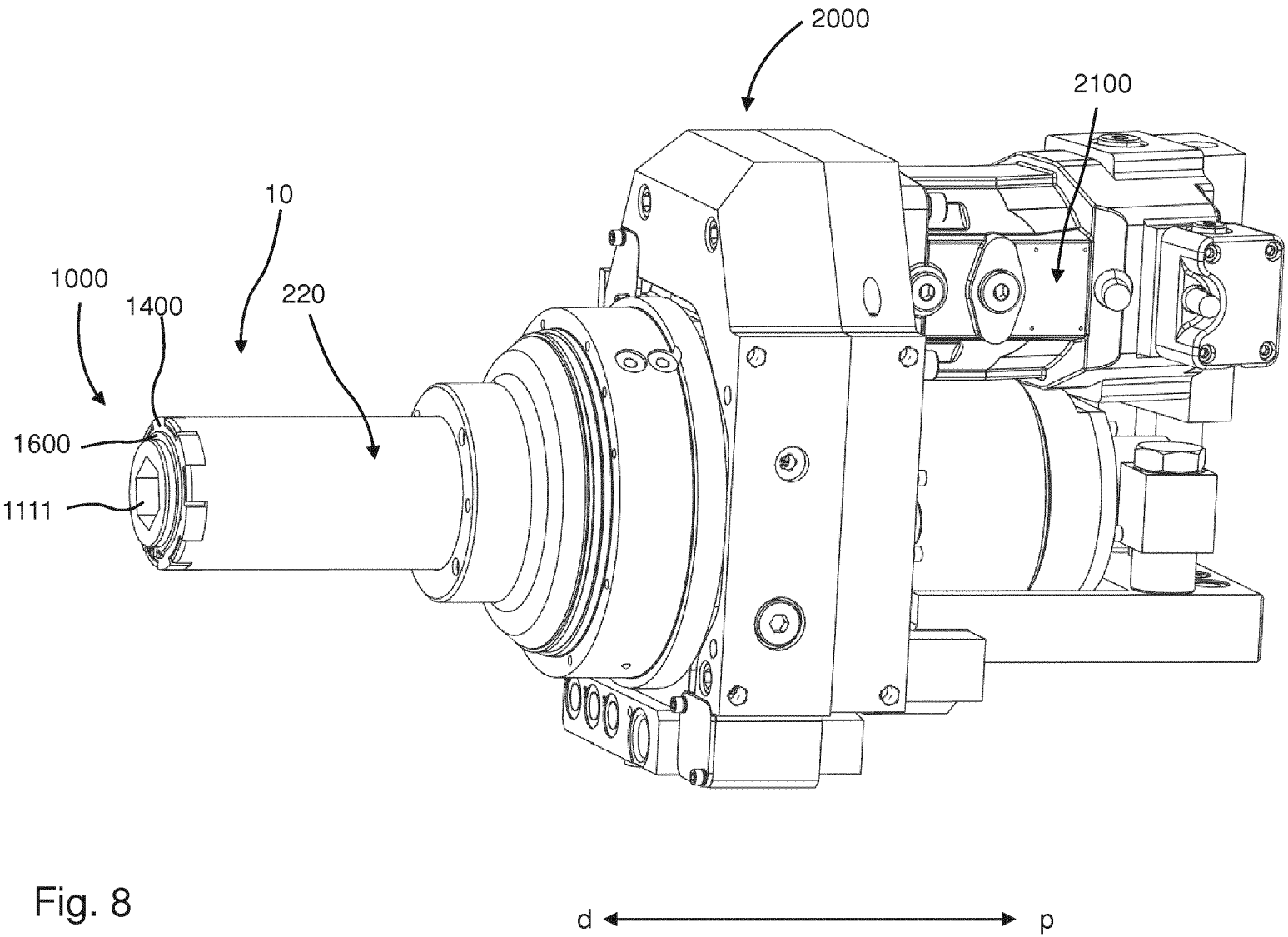
Figure 9:
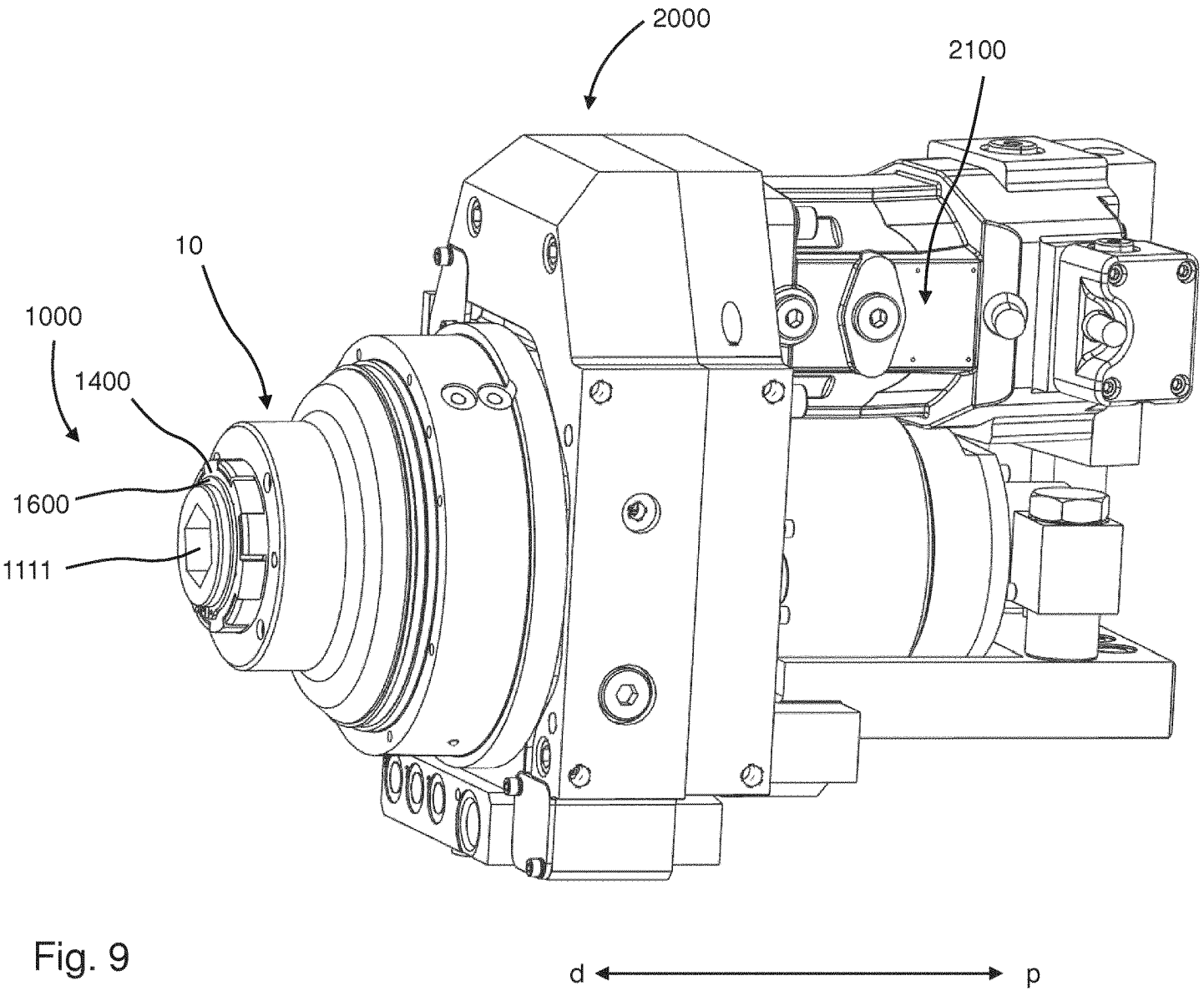
Figure 10:
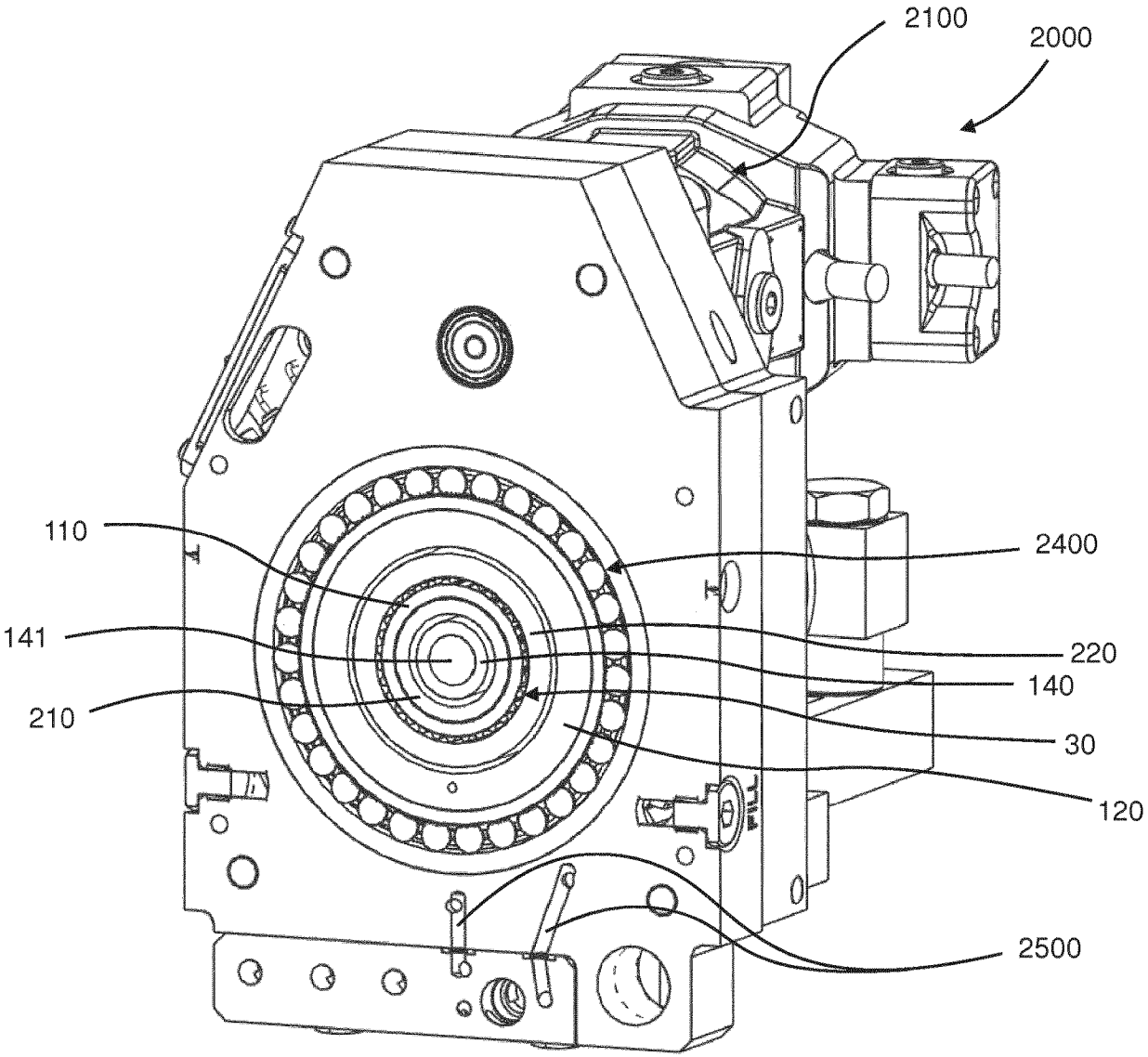
Figure 11:
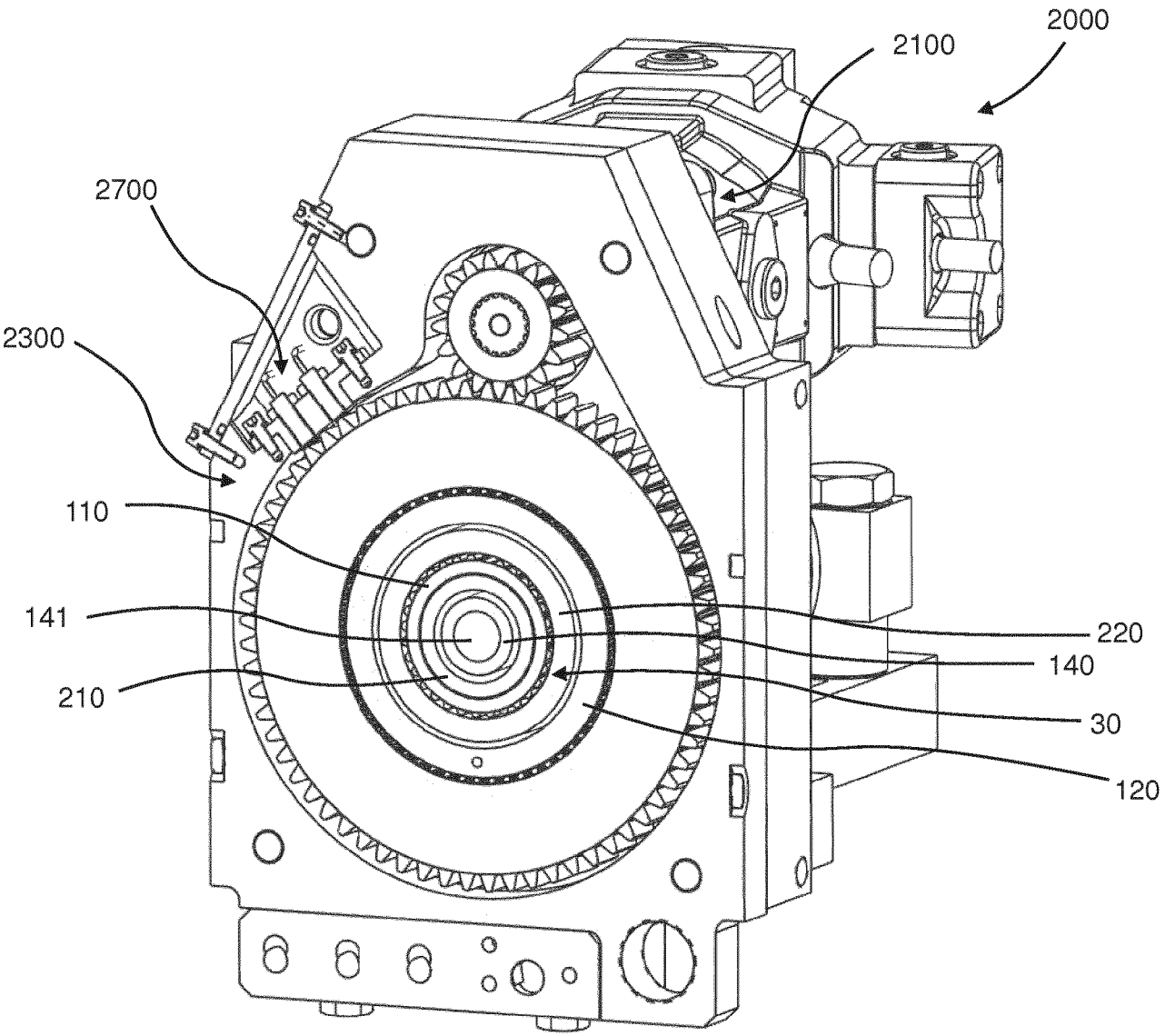
Figure 12:
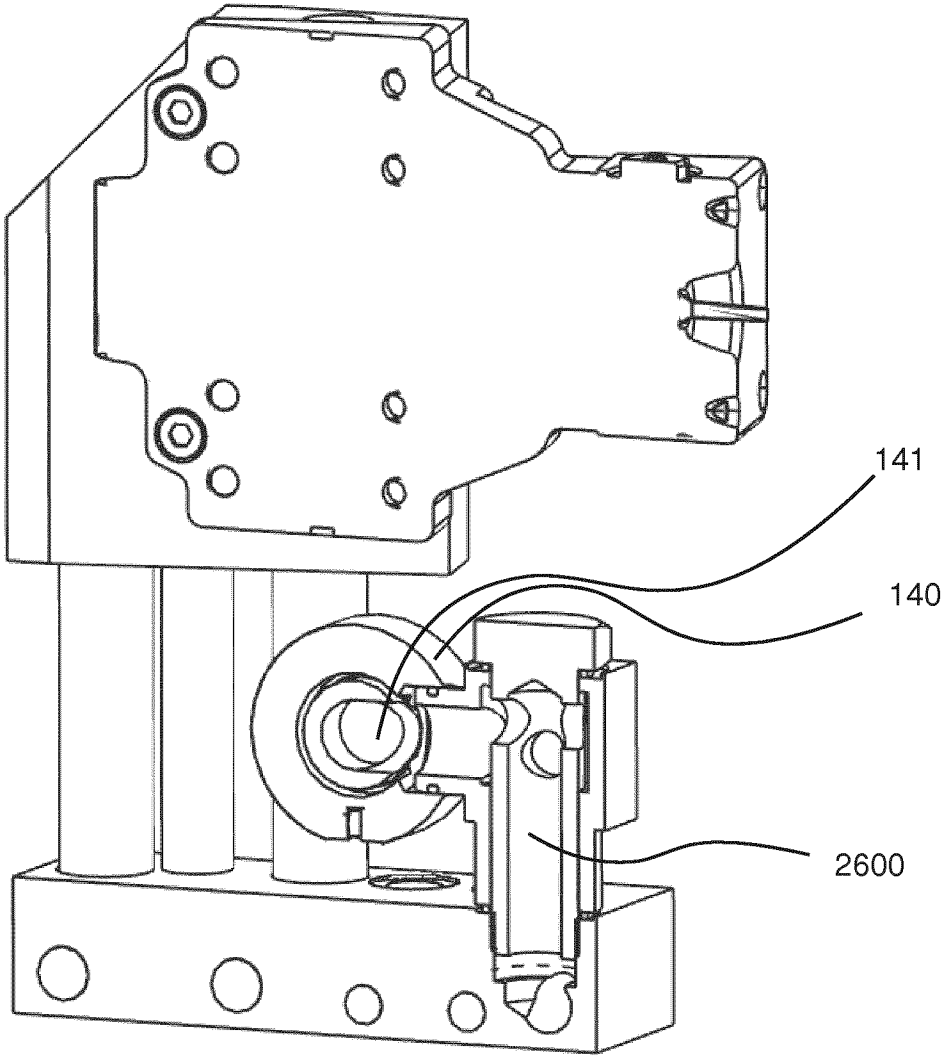
Figure 13:
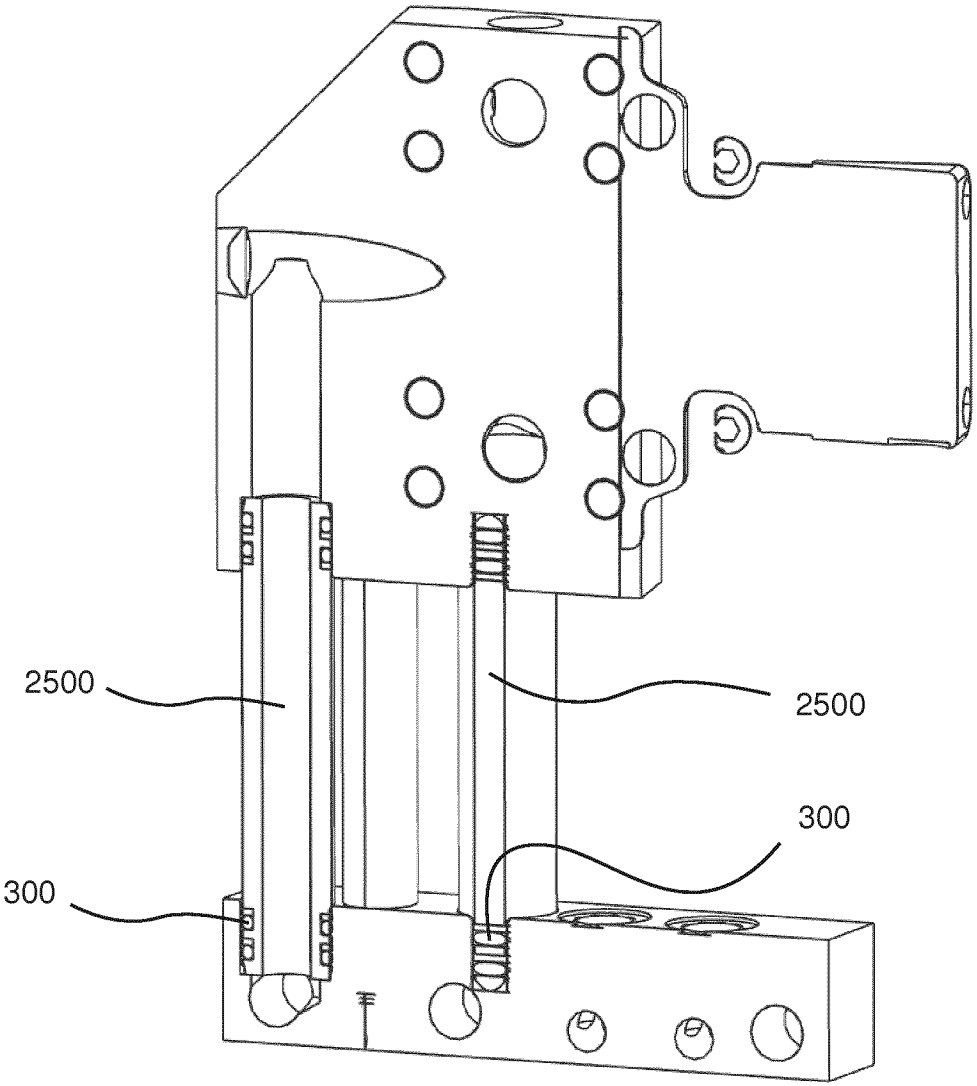

Preferred embodiments of the invention shall now be described with reference to the attached drawings, in which FIG. 1: a longitudinal cross section of a drill head with an extendable cylinder and a multi-functional connector in the extended position;

FIG. 2: a longitudinal cross section of the drill head of FIG. 1 in the retracted position;

FIG. 3: a three-dimensional depiction of the drill head according to FIG. 1 cut in the longitudinal direction;

FIG. 4: a three-dimensional depiction of the drill head according to FIG. 2 cut in the longitudinal direction;

FIG. 5: a three-dimensional depiction of the drill head according to FIG. 2;

FIG. 6: an enlarged view of FIG. 5 without the first connecting element and the retainer element;

FIG. 7: an enlarged view of FIG. 5 without the first connecting element;

FIG. 8: a three-dimensional depiction of the drill head according to FIG. 1;

FIG. 9: a three-dimensional depiction of the drill head according to FIG. 2;

FIG. 10: a three-dimensional depiction of the drill head cut in the area of the taper bearings;

FIG. 11: a three-dimensional depiction of the drill head cut in the area of the spur gear reduction stage;

FIG. 12: a three-dimensional depiction of the drill head cut in the area of the fluid or water connection; and FIG. 13: a three-dimensional depiction of the drill head in the area of the motor connections.

In FIGS. 1-13, a preferred example of a drill head 2000 with an extendable cylinder 10 and a multi-functional connector 1000 is shown. Although in the figures, the multi-functional connector 1000, the extendable cylinder 10 and the drill head 2000 are shown in combination, in particular the multi-functional connector 1000 and the extendable cylinder 10 described herein also can be applied separately.

FIGS. 1, 3, and 8 show the drill head 2000 with the extendable cylinder 10 in the extended position, while FIGS. 2, 4, and 9 show the drill head 2000 with the extendable cylinder 10 in its retracted position. FIGS. 5-7 show in particular details of the multi-functional connector 1000. FIGS. 10-13 in particular show details of the drill head 2000.

The drill head 2000 comprises a hydraulic motor 2100 for driving the extendable cylinder 10 connected with it via the spur gear reduction stage 2300. The extendable cylinder 10 is supported by taper roller bearings 2400 arranged back to back. The hydraulic motor 2100 is able to operate in two different speeds. The torque of the hydraulic motor 2100 is transferred to the cylinder 10 via a spur gear reduction stage 2300. The two rings of taper roller bearings 2400 are adapted to receive the loads and forces coming from operation of the drill head 2000. The drill head 2000, in particular the hydraulic motor 2100, is adapted to provide a rotation of the extendable cylinder 10 of up to 700 rpm and to apply a torque in the first and/or second direction of up to 400 Nm and a flow of hydraulic oil of up to 40 l/min.

The extendable cylinder 10 can be extended in a distal direction (d) by the provision of hydraulic fluid, as described below. The drill head 2000 comprises an extending union 2200 in the form of a rotating union for providing the hydraulic fluid to the rotating extendable cylinder 10. The multi-functional connector 1000 is connected to a distal end of the extendable cylinder 10.

The extendable cylinder 10 comprises a shaft 100 and a piston 200, which is movable relative to the shaft 100 along a longitudinal axis LX to extend or retract the extendable cylinder 10. The shaft has an inner part 110 and an outer part 120 and the piston has an inner part 210 and an outer part 220. The shaft 100 with its inner and outer parts 110, 120 and the piston 200 with its inner part 210 and its outer part 220 are substantially cylindrical in shape and arranged coaxially.

A shaft ring volume 101 is formed between the inner part 110 and the outer part 120 of the shaft and a piston ring volume 201 is formed between the inner part 210 and the outer part 220 of the piston 200. A proximal end 221 of the outer part 220 of the piston 200 is arranged between the inner and outer part 110, 120 of the shaft 100 and sealed against the outer part 120 of the shaft 100. A distal end 111 of the inner part 110 of the shaft 100 is arranged between the inner and outer parts 210, 220 of the piston 200. The proximal end 221 of the inner part 210 of the piston 200 is sealed against the inner part 110 of the shaft 100.

The piston 100 and the shaft 200 are connected by a torsionally rigid coupling 30, which is realized by a spline coupling between the outer part 220 of the piston 200 and the inner part 110 of the shaft 100. The splines of the spline coupling 30 extend in a direction parallel to the longitudinal axis LX. The spline coupling 30 has a longitudinal extension large enough to provide for a reliable torsionally rigid coupling between the shaft 100 and the piston 200 in the extended as well as in the retracted position, in particular when the hydraulic motor 2100 drives the extendable cylinder 10 in a rotational movement.

The shaft ring volume 101 and the piston ring volume 201 are in fluid communication with each other via the spline coupling 30.

By providing a hydraulic fluid via hydraulic fluid bores 2500 to the shaft ring volume 101 and/or the piston ring volume 201, the extendable cylinder 10 can be extended, this means brought from a position shown in FIG. 2 or 4 into the position shown in FIG. 1 or 3. The extendable cylinder 10 can be retracted by the provision of hydraulic fluid via hydraulic fluid bores 2500 to the intermediary ring volume 40. The intermediary ring volume 40 is preferably formed by a section 222 of the outer part 220 of the piston 200, which has a reduced outer diameter. Preferably, when hydraulic fluid is provided to the shaft and/or piston ring volume 101, 201, hydraulic fluid is retracted from the intermediary ring volume 40 and vice versa to allow for or facilitate the respective retraction or expansion movement.

Further, seals 300, in particular high-pressure seals where hydraulic fluid is applied, are arranged throughout the drill head 2000 and the extendable cylinder 10 with a multi-functional connector 1000 where needed. The high-pressure seals 300, in particular water seals and/or hydraulic fluid seals, preferably are adapted to withstand a fluid provision of 6 l/min at up to 180 bar.

The extendable cylinder 10 further comprises a supply channel 140 forming a central cavity 141 for supplying a fluid, for example water, to the piston 200, in particular an inner piston volume 212. A fluid, like water, can be supplied to the supply channel 140 via a fluid connection 2600. The supply channel 140 also has a substantially cylindrical shape and is arranged coaxially with the piston 200 and the shaft 100 and provided with respective seals 300 to create a sealed fluid channel.

Further, the extendable cylinder 10 comprises a transmission element 130 to transmit lateral forces. The transmission element 130 is arranged between the outer part 220 of the piston 200 and the outer part 120 of the shaft 100.

The force transmission element 130 is a ring-shaped element with an axial extension that exceeds its radial extension by a factor larger than 3. Further, the force transmission element 130 is connected to the outer part 220 of the piston 200 by form fit.

The rotating union 2200 is in fluid communication with the shaft ring volume 101 and/or the piston ring volume 201 and/or the intermediary ring volume 40 and adapted to provide and/or discharge hydraulic fluid from these volumes.

FIG. 10 shows in particular a ring of taper roller bearings 2400 as well as hydraulic fluid bores 2500 for providing hydraulic fluid to the piston, ring, and/or intermediary ring volume 201, 101, 40 for moving the piston 200. The spur gear reduction stage 2300 can be seen in particular in FIG. 11. FIG. 11 further shows speed sensors 2700 of the drill head 2000 to control the speed of the rotation. FIG. 12 shows in particular the fluid or water connection 2600 to provide fluid, like water, to the central cavity 141 of the supply channel 140. FIG. 13 shows in particular the hydraulic fluid bores 2500 providing the motor with hydraulic oil.

The multi-functional connector 1000 is connected to the outer part 220 of the piston 200 via a threaded connection 1700. To ensure that the threaded connection 1700 is not released during rotation of the extendable cylinder 10 with the multi-functional connector 1000 in a first or second, opposite direction, the multi-functional connector is secured via an engagement element 1400. The engagement element 1400 is arranged at an outer periphery of the first connecting element 1100 and adapted to engage the piston 200, in particular the outer part 220 of the piston 200 in a torsion proof way, in particular via a form fit, interlocking fit or positive fit. As can be seen in particular from FIG. 5, the engagement element 1400 has six evenly spaced recesses in its outer circumference and six corresponding protrusions on the distal end of the outer part 220 of the shaft 200 project into these recesses. The engagement element 1400 can be secured by a ring or e-clip 1600.

The multi-functional connector 1000 comprises a first connecting element 1100, a second connecting element 1300 and a retainer element 1200. The first connecting element has a first receptacle 1110 to receive a connecting section of a first functional drill element therein. Also the second connecting element 1300 has a second receptacle 1310 to receive a connecting section of a second functional drill element therein. The second connecting element 1300 is arranged proximal (p) to the first connecting element 1100 and the retainer element 1200 is arranged between the first and second connecting elements 1100, 1200. The retainer element 1200 has a retainer opening 1210 to receive the connecting section of the second functional drill element therethrough.

The first receptacle 1110 has a hexagonal cross-sectional shape and is particularly suitable to engage an anchor nut or tensioning rod. The first receptacle 1110 has six driving surfaces 1111 for transferring a torque in a first direction to at least two corresponding contact surfaces on the connecting section of the first functional drill element.

The second connecting element 1300 further has a fluid provision section 1500 with a cylindrical fluid channel for providing fluid from a proximal end of the multi-functional connector 1000 to the first and second connecting elements 1100, 1300 and the retainer element 1200.

The second receptacle 1310 is particularly suitable to engage a second functional drill element in the form of a drill steel with a connecting section having a square cross section. The second receptacle 1310 has four first driving surfaces 1311 for transferring a torque in a first direction to at least two corresponding first contact surfaces on the connecting section of the second functional drill element in a drill position of the second functional drill element. The second receptacle 1310 further has four second driving surfaces 1312 for transferring a torque in a second, opposite direction to at least two corresponding second contact surfaces on the connecting section of the second functional drill element in a retracting position of the second functional drill element. The first and second driving surfaces 1311, 1312 of the second receptacle 1310 are arranged alternating along a periphery of the second receptacle 1310. Between pairs of first and second driving surfaces 1311, 1312 rounded corners 1313 are arranged along the periphery of the second receptacle 1310. As can be seen in FIG. 6, four rounded corners 1313 are present in the second receptacle 1310 of the embodiment shown in the figures. Two adjacent first and second driving surfaces 1311, 1312 are preferably arranged under an angle toward each other or, in other words, the first driving surface 1311 is inclined to an adjacent second driving surface 1312. The first and second driving surfaces 1311, 1312 of the second receptacle 1310 are arranged to engage a connecting section of the second functional drill element with a square cross section.

The retainer element 1200 can be seen in particular in FIG. 7. The retainer element 1200 has at least two retaining sections 1213 to prevent a movement of the connecting section of the second functional drill element in a direction parallel to the longitudinal axis LX relative to the second connecting element 1300 in the retracting position of the second functional drill element.

The retainer element 1200 has four guiding surfaces 1211, wherein between adjacent guiding surfaces 1211 a rounded corner 1212 is arranged (in total four rounded corners). The four guiding surfaces 1211 are arranged to engage a connecting section of the second functional drill element with a square cross section in an orientation according to the drill position, in order to let the connecting section of the second functional drill element pass the retainer opening 1210 in its drill position. In the drill position, the connecting section of the second functional drill element would contact the first driving surfaces 1311 of the second receptacle 1300 and the guiding surfaces 1211 of the retainer element 1200. In the retracting position of the connecting section of the second functional drill element, only the second driving surfaces 1312 of the second receptacle 1300 would be contacted by the connecting section of the second functional drill element, which would be retained in a longitudinal direction by the retaining sections 1213 of the retainer element 1200.

As can be seen in particular from FIG. 5, an inner envelope of the cross section at the first receptacle 1110 envelopes the cross section of the second receptacle 1310 as well as the cross section of the retainer opening 1210.

With the drill head 2000 comprising an extendable cylinder 10 and a multi-functional connector 1000 as described before, a method for drilling an anchor hole and for tightening an anchor nut can be improved and facilitated. For example, a drill steel as a first functional drill element with a connecting section with a square cross section can be inserted through the first receptacle 1110 and the retainer opening 1210 into the second receptacle 1310 in a drill position. The extendable cylinder 10 can then be rotated by the hydraulic motor 2100 in a first direction, which results in a corresponding rotation of the drill steel via the first driving surfaces 1311 to drill the anchor hole. When the desired length of the anchor hole is reached, the extendable cylinder 10 can be driven by the hydraulic motor 2100 into a second, opposite direction with the drill steel in the retracting position. Then the drill steel can be retracted together with the extendable cylinder 10 and the multi-functional connector 1000 from the anchor hole, while the retaining sections 1213 of the retainer element 1200 of the multi-functional connector 1000 prevent a relative longitudinal movement of the drill steel relative to the multi-functional connector 1000. To remove the drill steel from the multi-functional connector 1000, the cylinder 10 is rotated by the hydraulic motor 2100 in the first direction, to bring the drill steel into the drill position and to release it from the retaining sections 1213 of the retainer element 1200.

When the drill steel is removed from the multi-functional connector 1000, a tensioning rod can be connected to the first receptacle 1110 or an anchor nut of an anchor can be engaged by the first receptacle 1110. It can be preferred to extend the piston 200 relative to the shaft 100 before the anchor nut is engaged or before the extendable cylinder 10 is then rotated in the first direction to tighten the anchor nut of the anchor.

By providing the multi-functional connector 1000 and by providing an extendable cylinder 10, the same drill head 2000 can be used for drilling the anchor hole and for tightening an anchor nut without the use of dollies or other adapters. This increases safety and facilitates handling. It further provides for a higher degree in automation of the process of drilling an anchor hole and tightening an anchor nut.

REFERENCE SIGNS

LX longitudinal axis
d distal
P proximal
10 cylinder
30 torsionally rigid coupling
40 intermediary ring volume
100 shaft
101 shaft ring volume
110 inner part of the shaft
111 distal end of the inner part of the shaft
120 outer part of the shaft
130 transmission element
140 supply channel
141 central cavity
200 piston
201 piston ring volume
202 distal end of the piston
210 inner part of the piston
212 inner piston volume
220 outer part of the piston
221 proximal end of the outer part of the piston
300 seals
1000 multi-functional connector
1100 first connecting element
1110 first receptacle
1111 driving surfaces of first receptacle
1200 retainer element
1210 retainer opening
1211 guiding surfaces

1212 rounded corners
1213 retaining sections
1300 second connecting element
1310 second receptacle
1311 first driving surfaces of the second receptacle
1312 second driving surfaces of the second receptacle
1313 rounded corners
1400 engagement element
1500 fluid provision section
1600 ring
1700 threaded connection
2000 drill head
2100 hydraulic motor
2200 extending union
2300 spur gear reduction stage
2400 taper roller bearings
2500 hydraulic fluid bores
2600 fluid connection
2700 speed sensors

The invention claimed is:

1. A multi-functional connector for connecting a functional drill element to a drill head, in particular to an extendable cylinder of a drill head, the multi-functional connector comprising:

a first connecting element with a first receptacle arranged to receive a connecting section of a first functional drill element therein;

a second connecting element arranged proximal to the first connecting element in a direction of a longitudinal axis of the multi-functional connector with a second receptacle arranged to receive a connecting section of a second functional drill element therein; and a retainer element arranged between the first and the second connecting elements, the retainer element having a retainer opening for receiving the connecting section of the second functional drill element therethrough, wherein the first receptacle has at least two driving surfaces for transferring a torque in a first direction to at least two corresponding contact surfaces on the connecting section of the first functional drill element, the second receptacle has at least two driving surfaces for transferring a torque in a first direction and in a second, opposite direction to at least two corresponding contact surfaces on the connecting section of the second functional drill element in a drill and/or retracting position of the second functional drill element, and wherein the retainer element has at least one retaining section to prevent a movement of the connecting section of the second functional drill element in a direction parallel to the longitudinal axis relative to the second connecting element in the retracting position of the second functional drill element.

2. The multi-functional connector according to claim 1, wherein the second receptacle has at least two first driving surfaces for transferring a torque in a first direction to at least two corresponding first contact surfaces on the connecting section of the second functional drill element in a drill position of the second functional drill element, and wherein the second receptacle has at least two second driving surfaces for transferring a torque in a second, opposite direction to at least two corresponding second contact surfaces on the connecting section of the second functional drill element in a retracting position of the second functional drill element.

3. The multi-functional connector according to claim 2, wherein the first and second driving surfaces are arranged alternating along a periphery of the second receptacle.

4. The multi-functional connector (1000) according to claim 1, wherein between pairs of first and second driving surfaces rounded corners are arranged along the periphery of the second receptacle.

5. The multi-functional connector according to claim 2, wherein the first driving surfaces and/or the second driving surfaces of the second receptacle are arranged to engage a connecting section of the second functional drill element with a square cross section.

6. The multi-functional connector according to claim 1, wherein the retainer element has at least two retaining sections arranged to prevent a movement of the connecting section of the second functional drill element in a direction parallel to the longitudinal axis relative to the second connecting element in the retracting position of the second functional drill element.

7. The multi-functional connector according to claim 1, wherein the first receptacle has a hexagonal cross sectional shape.

8. The multi-functional connector according to claim 1, wherein an inner envelop of the cross section of the first receptacle envelops the cross section of the second receptacle and/or the retainer opening.

9. The multi-functional connector according to claim 1, wherein the retainer element has at least two guiding surfaces.

10. The multi-functional connector according to claim 9, wherein between the at least two guiding surfaces a rounded corner is arranged.

11. The multi-functional connector according to claim 9, wherein the at least two guiding surfaces are arranged to engage a connecting section of the second functional drill element with a square cross section in an orientation according to the drill position.

12. The multi-functional connector according to claim 1, further comprising an engagement element arranged at an outer periphery of the first connecting element and being arranged to engage a cylinder of a drill head in a torsion proof way.

13. The multi-functional connector according to claim 1, further comprising a fluid provision section with a fluid channel for providing fluid from a proximal end of the connector to the first connecting element and/or the second connecting element and/or the retainer element.

14. A drill head, comprising:

an extendable cylinder with a shaft and a piston, the piston being moveable with respect to the shaft along a longitudinal axis;

a drive for rotationally driving the shaft of the extendable cylinder;

an extending union arranged to extend and/or retract the extendable cylinder along the longitudinal axis; and a multi-functional connector disposed at a distal end of the piston for connecting a functional drill element thereto, the multi-functional connector including a first connecting element having a first receptacle arranged to receive a connecting section of a first functional drill element therein, a second connecting element arranged proximal to the first connecting element in a direction of a longitudinal axis of the multi-functional connector with a second receptacle arranged to receive a connecting section of a second functional drill element therein, and a retainer element arranged between the first and the second connecting elements, the retainer element having a retainer opening for receiving the connecting section of the second functional drill element therethrough, wherein the first receptacle has at least two driving surfaces for transferring a torque in a first direction to at least two corresponding contact surfaces on the connecting section of the first functional drill element, the second receptacle having at least two driving surfaces for transferring a torque in a first direction and in a second, opposite direction to at least two corresponding contact surfaces on the connecting section of the second functional drill element in a drill and/or retracting position of the second functional drill element, and wherein the retainer element has at least one retaining section to prevent a movement of the connecting section of the second functional drill element in a direction parallel to the longitudinal axis relative to the second connecting element in the retracting position of the second functional drill element.

15. A method for drilling an anchor hole and for tightening an anchor nut, the method comprising:

providing a drill head with a multi-functional connector, the multi-functional connector including a first connecting element having a first receptacle arranged to receive a connecting section of a first functional drill element therein, a second connecting element arranged proximal to the first connecting element in a direction of a longitudinal axis of the multi-functional connector with a second receptacle arranged to receive a connecting section of a second functional drill element therein, and a retainer element arranged between the first and the second connecting elements, the retainer element having a retainer opening for receiving the connecting section of the second functional drill element therethrough, wherein the first receptacle has at least two driving surfaces for transferring a torque in a first direction to at least two corresponding contact surfaces on the connecting section of the first functional drill element, the second receptacle having at least two driving surfaces for transferring a torque in a first direction and in a second, opposite direction to at least two corresponding contact surfaces on the connecting section of the second functional drill element in a drill and/or retracting position of the second functional drill element, and wherein the retainer element has at least one retaining section to prevent a movement of the connecting section of the second functional drill element in a direction parallel to the longitudinal axis relative to the second connecting element in the retracting position of the second functional drill element;

providing a drill steel as the first functional drill element;

inserting the drill steel trough the first receptacle and the retainer opening into the second receptacle in the drill position;

rotating a cylinder of the drill head with the multi-functional connector in a first direction;

rotating the cylinder of the drill head with the multi-functional connector in a second, opposite direction to bring the drill steel into the retracting position;

retracting the cylinder with the connector and the drill steel;

rotating the cylinder of the drill head with the multi-functional connector in the first direction to bring the drill steel into the drill position;

removing the drill steel from the multi-functional connector;

engaging the anchor nut of an anchor with the first receptacle; and rotating a cylinder of the drill head with the multi-functional connector in a first direction.

* * * * *